US008955577B2

(12) United States Patent
Colombo et al.

(10) Patent No.: US 8,955,577 B2
(45) Date of Patent: Feb. 17, 2015

(54) APPARATUS AND METHOD FOR PRODUCTION OF METAL ELONGATED PRODUCTS

(75) Inventors: Ezio Colombo, Milan (IT); Ugo Zanelli, Tavagnacco (IT)

(73) Assignee: Siemens S.p.A., Milan (IT)

( * ) Notice: Subject to any disclaimer, the term of this patent is extended or adjusted under 35 U.S.C. 154(b) by 0 days.

(21) Appl. No.: 13/519,632

(22) PCT Filed: Jul. 5, 2011

(86) PCT No.: PCT/EP2011/061325

§ 371 (c)(1),
(2), (4) Date: Jun. 28, 2012

(87) PCT Pub. No.: WO2012/013456

PCT Pub. Date: Feb. 2, 2012

(65) Prior Publication Data

US 2013/0112365 A1 May 9, 2013

(30) Foreign Application Priority Data

Jul. 26, 2010 (EP) ..... 10425252

(51) Int. Cl.

| | |
|---|---|
| ***B22D 11/14*** | (2006.01) |
| ***B22D 11/12*** | (2006.01) |
| ***B22D 11/20*** | (2006.01) |
| ***B22D 11/126*** | (2006.01) |
| *B21B 1/46* | (2006.01) |

(52) U.S. Cl.

CPC ..... *B22D 11/147* (2013.01); *B22D 11/14* (2013.01); *B22D 11/20* (2013.01);

(Continued)

(58) Field of Classification Search

CPC ..... B22D 11/1206; B22D 11/1213; B22D 11/126; B22D 11/14; B22D 11/20; B21B 1/18; B21B 1/463; B21B 1/466

USPC ..... 164/263, 420, 459, 460, 462, 471, 476, 164/507; 29/33 C, 527.5–527.7

See application file for complete search history.

(56) References Cited

U.S. PATENT DOCUMENTS 4,289,944 A * 9/1981 Reese ..... 219/655
5,467,519 A * 11/1995 Tippins et al. ..... 29/527.7

(Continued)

FOREIGN PATENT DOCUMENTS

CN 1192171 A 9/1998
CN 1228042 A 9/1999

(Continued)

*Primary Examiner* — Kevin E Yoon

(74) *Attorney, Agent, or Firm* — Laurence A. Greenberg; Werner H. Stemer; Ralph E. Locher

(57) ABSTRACT

An apparatus for producing elongated rolled products contains a steelmaking station for producing liquid metal having at a first production rate, a rolling mill having a second production rate, and a continuous casting station located between the steelmaking station and the rolling mill. The continuous casting station contains at least two casting lines, each line being operable to produce elongated intermediate products. A first casting line is directly aligned with the rolling mill to feed the rolling mill with casted products, and at least one second casting line not aligned with the rolling mill and not feeding the rolling mill. The apparatus further contains a varying device for varying simultaneously the production rate of the first casting line and the production rate of the at least one second casting line depending on a difference between the steelmaking station production rate and the rolling mill production rate.

9 Claims, 1 Drawing Sheet

(52) U.S. Cl.
CPC ..... *B22D 11/1206* (2013.01); *B22D 11/1213* (2013.01); *B22D 11/126* (2013.01); *B21B 1/463* (2013.01); *B21B 1/466* (2013.01)
USPC ..... 164/420; 164/263; 164/442; 164/476

(56) References Cited

U.S. PATENT DOCUMENTS

| | | | | |
|---|---|---|---|---|
| 5,915,457 | A | 6/1999 | Pleschiutschnigg | |
| 5,924,184 | A | 7/1999 | Donini et al. | |
| 5,946,783 | A * | 9/1999 | Plociennik et al. | 29/33 C |
| 5,970,594 | A * | 10/1999 | Borsi et al. | 29/81.08 |
| 6,240,617 | B1 | 6/2001 | Nitoh et al. | |
| 6,240,763 | B1 * | 6/2001 | Benedetti | 72/239 |
| 6,282,767 | B1 | 9/2001 | Borsi et al. | |
| 6,289,972 | B1 | 9/2001 | Benedetti | |
| 6,647,604 | B2 * | 11/2003 | Sclippa | 29/33 C |

FOREIGN PATENT DOCUMENTS

| | | |
|---|---|---|
| EP | 1 187 686 B1 | 7/2003 |
| GB | 1 267 765 A | 3/1972 |
| JP | 55097852 A | 7/1980 |

* cited by examiner

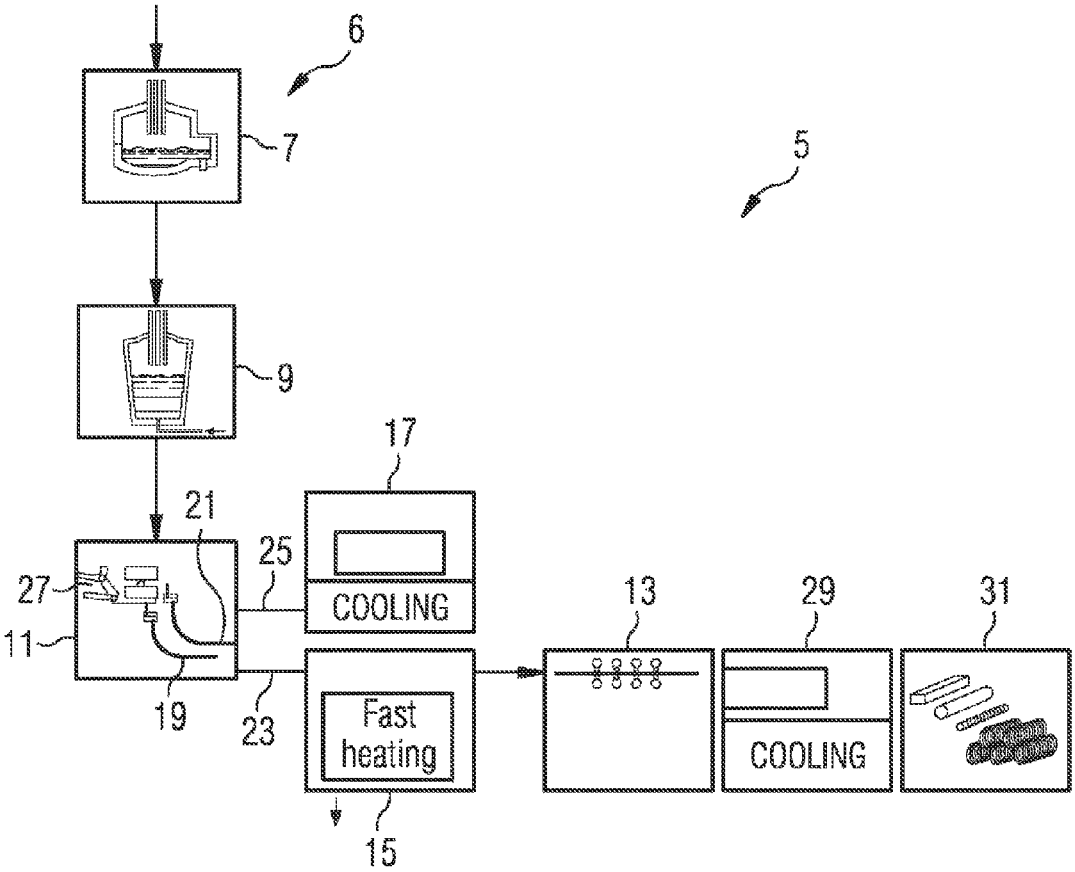
6
7
5
9
17
21
25
27
COOLING
13
29
31
11
19
23
Fast heating
COOLING
15

APPARATUS AND METHOD FOR PRODUCTION OF METAL ELONGATED PRODUCTS

BACKGROUND OF THE INVENTION

Field of the Invention

The present invention relates to a plant and a method for the production of elongated products.

The production of metal elongated long products is realized in a plant by a succession of steps. In a first step, metallic scraps are provided as feeding material to a furnace which heats the scraps up to reach the liquid status. Afterwards, continuous casting equipment is used to cool the liquid metal down and to form a suitable sized product, for example a billet, to create a suitable feeding stock for a rolling mill. Typically this feeding section is cut and cooled down into cooling beds. Thereafter, a rolling mill is used to transform the feeding stock or billet in different sizes suitable to be used in mechanical industry. To obtain this result, the rolling mill pre-heat the feeding stock to a suitable temperature it to be rolled by multiple equipments called stands and normally the feeding stock is reduced to the final size. The final sized product is normally cut at hot condition, cooled down in a cooling bed and finally cut and packed to be ready for deliverance to the customer.

The document EP1187686 discloses an apparatus for the production of elongated rolled product comprising a continuous casting equipment producing a plurality of parallel lines of elongated product, a rolling mill positioned downstream of said continuous casting equipment in alignment with one of said lines of product, a tunnel furnace disposed intermediate said continuous casting equipment and said rolling mill along said one line of product.

This apparatus further includes parallel roller conveyors associated with each of said plurality of parallel lines of product and means provided for operating said parallel roller conveyors at reciprocally different velocity, said parallel roller conveyors and said transfer means being adapted such that a billet on said laterally displaced line of product, after being cut, is accelerated at such a speed as to recover the time necessary for carrying out translation towards a billet on said one line of product.

A drawback of this apparatus is that if a problem occurs in the rolling mill the entire production has to be stopped because of the close relationship between the rolling mill and each parallel line of elongated product coming from the casting equipment.

In the very same manner, the entire production need to be stop if a problem occurs on the lines of product aligned with the rolling mill, as all billets product on the other lines need to be transferred on this line to be rolled by the rolling mill.

Furthermore this solution also implies transfer devices for the synchronisation of the motion of each billet produced by each casting line as they need to be rolled consecutively without lost in production rate. Those transfer and synchronisation means add failure risks and therefore lost of production rate for the whole apparatus.

Indeed, in this solution because the entire production of the each parallel line of elongated product coming from the casting equipment has to be absorbed by the rolling mill, a problem at one point of the production line may causes the stop of the whole production.

BRIEF SUMMARY OF THE INVENTION

It is a an object of the present invention to solve the above mentioned problems and to provide a plant for production of elongated products having a plurality of casting line wherein the production of one line can not be disturb by problem occurring on another line.

It is another object of the present invention to provide a plant for production of elongated product wherein the production of elongated product can be maintained even if a problem occurs on the casting line aligned with the rolling equipment.

These objects are achieved according to a first aspect of the present invention by means of an apparatus for production of elongated rolled products comprising:

- a steelmaking station for producing liquid metal having at a first production rate,
- a rolling mill (13) having a second production rate
- a continuous casting station (11) located between the steelmaking station and the rolling mill (13), the continuous casting station (11) comprising at least two casting lines (21,19), each line being operable to produce elongated intermediate products, wherein:

- a first casting line is directly aligned with (or is configured to directly feed) the rolling mill to feed the rolling mill with casted product, and
- at least a second casting line not aligned with the rolling mill and not feeding the rolling mill, the apparatus further comprising varying means (27) for varying simultaneously the production rate of the first casting line and the production rate of at least the second casting line depending on the difference between the steelmaking station production rate and the rolling mill production rate.

According to other features take in combination or alone:

- the varying means (27) are operable to increase the production rate of the first casting line (19) while simultaneously decreasing the production rate of the second casting line (21).
- the varying means (27) are operable to decrease the production rate of the first casting line (19) while simultaneously increasing the production rate of the second casting line (21).
- the varying means comprise means for varying the amount of molten metal arriving in the casting machine and a continuous casting mould with two exits having fixed geometrical characteristics.
- at least one of the continuous casting lines is provided with a valve, the valve motion causing the variation of production rate of at least two casting lines,
- at least two continuous casting lines are provided with valves which vary the valve motion causing the variation of production rate of at least two casting lines.
- the apparatus comprises means (15) to homogenize the temperature of the intermediate product coming from the first casting line, said means being located between the caster and the rolling mill, such as an induction furnace,
- the apparatus further comprises means operable to cut the intermediate product coming from the first casting line (21) in case of emergency and means operable to cut the intermediate product coming from at least the second casting line to produce deliverable semi-finished product.

According to another aspect the present invention concerns a method of production of metal elongated products consisting of:

- producing liquid metal at a first production rate,
- continuously casting the liquid metal to produce at least a first and a second elongated intermediate products, characterised in that the method further comprises the step consisting of:

rolling the first elongated product at a second production rate different from the first production rate, the second elongating product not being rolled, varying simultaneously the casting production rate of the first and the second elongated product depending on the difference of production rate between the first and the second production rate.

According to an embodiment, when the production rate of the first elongated product is decreased the production rate of the second elongated product is increased simultaneously.

Furthermore when the production rate of the first elongated product is increased the production rate of the second elongated product is decreased simultaneously.

BRIEF DESCRIPTION OF THE SEVERAL VIEWS OF THE DRAWING

The structural and functional characteristics of the present invention and its advantages over the technique known from the prior art will be better understood from the following disclosure, made by referring to the hereto attached non limiting unique drawing which is a schematic view of an apparatus according to the invention.

DESCRIPTION OF THE INVENTION

The apparatus 5 according to the invention comprises means 7, 9 to transform metallic scraps into liquid metal, a continuous casting machine 11 and a rolling mill 13, each of them being described hereunder.

The means or system to transform metallic scrap (mainly steel scraps) into liquid steel, also called steelmaking station, may comprise an Electrical Arc Furnace (EAF) 7 or another mean such as an induction arc furnace. Those means may also comprise a ladle furnace 9.

The continuous casting machine 11 receives the molten metal from the ladle furnace 9 and comprises at least a first 19 and a second 21 casting line also called strands. In other words, the casting machine 11 has two exits each one producing an elongated intermediate product 23, 25, such as billets, blooms, or intermediate products with other shapes. The first casting line 19 is designed to feed directly the rolling mill 13. To that purpose, the first casting line 19 may be aligned with the rolling mill 13. The second casting line 21 is not aligned with the rolling mill but may be parallel to the first feeding casting line 19.

The main purpose of the flexible direct feeding is to have two casting lines 19 and 21 to balance the production rate of the rolling mill 13 and the production of the continuous casting machine 11. According to the invention, only one casting line, the first line 19 is feeding the rolling mill meanwhile the second line 19 is feeding a continuous casting cooling bed 29.

To that purpose, apparatus 5 comprises varying means 27 for varying simultaneously the production rate of the first casting line 19 and the production rate of at least the second casting line 21 depending on the difference between the steelmaking station production rate and the rolling mill production rate. The production rate of the first 19, respectively second 21, casting line is the amount of intermediate elongated product 23 or 25 produced by the first, respectively second casting line 21 for example measured in tons by hour (Tons/h). In the very same manner the steelmaking station 6 production rate is the amount of liquid metal delivered by this device in Ton/h and the rolling mill production rate is the amount of rolled product delivered by this device.

The main effect of the design of the new continuous casting machine 11 is to have the second casting line 21 not directly linked to rolling mill 13 allowing balancing of production rate variations between steelmaking and rolling. In other words the varying amount of intermediate elongated product produced by the second casting line 25 regulates the flow of liquid metal coming from the steelmaking station. This is done by creating a deviation of a part of the production of liquid metal, this deviated part not being rolled. Therefore, the link between the entry of the production line, namely the liquid metal and the exit of the production line, namely the rolled product can be modulated. This allows a continuation of the production even if a problem occurs at a point of the production line downstream from the continuous casting machine, or if a problem occurs in the first casting or in the second casting line.

As already mentioned, the apparatus according to the invention also includes a rolling mill 13 designed to receive directly intermediate elongated products 23 coming from the first continuous line 19. The rolling mill 13 comprises a plurality of stands equipped with rolls designed to roll the intermediate elongated product 23 to modify his cross section to obtain a finished long product 31 deliverable to a client. The rolling mill 13 may also comprises an equalization system to keep the temperature homogeneous in the elongated long product.

A fast heating device 15 such as an induction furnace is interposed between the continuous casting machine 11 and the rolling mill 13 in order to homogenise the product temperature. However, the fast heating device 15 can be avoided and a proper cooling distribution system in the continuous casting machine 11 can be used instead.

In one embodiment the varying means for varying simultaneously the production rate of the first casting line and the production rate of at least a second casting line can comprise a continuous casting mould with two exits having the fixed geometrical characteristic, the two exits or holes having the fixed production rate ratio. In this embodiment the variation of production rate of the first and the second casting line is realized by varying the amount of molten metal arriving in the mould.

In another embodiment at least one exit of the casting machine is provided with a valve which varies the exit cross section of the exit. The valve motion cause the variation of production rate of at least two casting lines.

In another embodiment, at least two exits of the casting machine are provided with valves which vary the exit cross section. The valves may vary simultaneously the cross section of the two exits.

In one embodiment, an apparatus according to the invention includes a steelmaking station 6 with a production rate comprised between 40-65 Ton/h. The steelmaking station feeds at least two lines of the continuous casting machine 11 (changing tap to tap time and using different scrap density). The first casting line 19 may have a production rate comprised between 30 to 50 Ton/h. The second casting line 21 has a production rate comprised between 15-45 ton/h.

According to the invention, in a standard situation, the casting speed or production rate of the first casting line 19 is related to the rolling mill speed or production rate. The second casting line 21 is designed to balance the overall production rate. This means that when the rolling mill increases his production rate or speed (in an allowable range) the casting speed or production rate of the direct feeding line 19 is increased and the casting speed or production rate of the second casting line 21 is decreased.

In case there is a need to decrease the rolling mill production rate, the first casting line production rate is decreased and the second casting line production rate is increased. The same balancing procedure is used if for reasons due to the casting procedure the direct casting feed has to be increased or decreased.

The same balancing procedure is also applied when the steelmaking production is increased or decreased. For instance when the first casting line 19 is running at a production rate of 30 ton/h, the second casting line balances the steelmaking production with additional 25 ton/h to keep the overall steelmaking production at about 55 Ton/h.

The production rate of the rolling mill 13 may by increased by step to allow the direct feeding casting line 23 (the first casting line) to reach higher production rate up to 35-40-45-50 Ton/h. In this case the production of the second line 21 is decreases to reach 20 and 15 Ton/h. This keeps the production rate value of the steelmaking constant at 55 ton/h. With this increase of the rolling mill production, the production rate of the steelmaking may also be increase up to 60 and 65 Ton/h to keep the overall production balanced.

The present invention also provides a good solution in emergency situations. For example, when the rolling mill 13 is stopped, the second casting line 21 may increase his production capacity to reach 45 ton/h. This allows stopping the first casting line 19 and keeps steelmaking production in a normal rate.

Therefore, in case of long duration stop for cobbles or maintenance problems the apparatus 5 and the method according to the invention provide the possibility to produce intermediate products without stopping for long time the steelmaking production.

The invention also provides a good solution in case of short stop for operational change. The rolling mill being designed to work continuously, it can be necessary to stop the rolling mill for operational change such as groove change, knives change, guide change which could not be always performed during the direct feeding line stop. In this case the second line is able to produce intermediate products allowing restarting the system as soon as possible. It means the first casting line is stopping the casting procedure or eventually producing intermediate material for subsequent treatment, the additional material passing by the second casting line 21 which produces more intermediate material 25. The intermediate material 25 is subsequently cut and delivered to a cooling bed 31 located downstream from the second casting line 21.

During normal casting operation, for reasons related to consumption of casting material like refractory or else, the casting procedures on the first casting line 21 has to be stopped prior to a possible restart of operations (normally between 8 to maximum 24 hours). In this case it is possible to stop also the second casting line or to maintain the second casting line in operation to optimize the steelmaking production.

Another advantage of the flexible direct feed system according to the invention is that in the second casting line any type of casting mould operable to produce different billet size (from 100 to 150 mm for example) can be installed, whereas the first casting line is strictly linked to rolling mill with only one size of billet can be rolled (mainly in the range between 120-130 mm). In other words the first and the second casting line can produce different type (in size and shape) of intermediate products.

Cutting devices (not shown on the drawing) are also provided at the exit of the continuous casting machine 11, and downstream from the second casting line in order to cut the intermediate product (billets) before cooling in a cooling bed 17. Further cutting means are provided at the exit of the first casting line to cut the intermediate product in case of emergency and upstream from the continuous casting machine. Additional cutting device may be forecast upstream from the rolling mill 13.

The main advantages of the invention are the following:

- in case of variation of speed in the rolling mill the second casting line make the balance, reducing or increasing the production speed to keep the production rate of the system balanced,
- optimum size and production rate for steelmaking is achieved
- in case of stop in the rolling mill it is still possible to stop the direct linked line without stopping the steelmaking,
- a user can produce semi-finished product,
- the possibility to use the second line as feeding line when the direct linked line is stopped
- the possibility to introduce multiple lines to reach higher capability of the steelmaking
- the EAF can be designed to any desired production capacity to feed a continuous casting machine of at least two lines, it is known that in term of efficiency a higher furnace capacity has main advantages with respect to lower capacity furnace due to the fact that the heat losses of the furnace are less in higher capacity furnace, the investment in the mechanical and electrical components not being directly proportional to furnace capacity. Increasing the capacity rate has not the effect to increase the investment of the same amount.

The invention claimed is:

1. An apparatus for producing elongated rolled products, the apparatus comprising:

- a steelmaking station for producing liquid metal at a first production rate;
- a rolling mill having a second production rate;
- a further processing unit disposed downstream of said rolling mill for further processing products made from the liquid metal;
- a continuous casting station disposed between said steelmaking station and said rolling mill, said continuous casting station containing at least two casting lines, each of said at least two casting lines being operable to produce elongated intermediate products, including billets or blooms, said at least two casting lines including a first casting line directly aligned with said rolling mill to directly feed said rolling mill with casted product and at least one second casting line never aligned with said rolling mill, said at least one second casting line configured to bypass all rolling mills including said rolling mill and feed said further processing unit disposed downstream of said rolling mill; and
- varying means for varying simultaneously a production rate of said first casting line and a production rate of said at least one second casting line depending on a difference between the first production rate and the second production rate.

2. The apparatus according to claim 1, wherein said varying means being operable to increase the production rate of said first casting line while simultaneously decreasing the production rate of said at least one second casting line.

3. The apparatus according to claim 1,

- wherein said varying means are operable to decrease the production rate of said first casting line while simultaneously increasing the production rate of said at least one second casting line; and
- wherein said further processing unit is a cooling bed, said at least one second casting line feeding said cooling bed.

4. The apparatus according to claim 1, wherein said varying means contains a continuous casting mold with two exits having fixed geometrical characteristics, a variation of the production rate of said first casting line and of said at least one second casting line being realized by varying an amount of molten metal arriving in said continuous casting mold.

5. The apparatus according to claim 1, wherein at least one of said at least two casting lines has a valve and a valve motion causing a variation of the production rate of said at least two casting lines.

6. The apparatus according to claim 1, wherein said at least two casting lines have valves which vary a valve motion causing a variation of the production rate of said at least two casting lines.

7. The apparatus according to claim 1, further comprising means to homogenize a temperature of the intermediate elongated product coming from said first casting line, said means to homogenize disposed between said continuous casting station and said rolling mill.

8. The apparatus according to claim 7, wherein said means to homogenize is an induction furnace.

9. The apparatus according to claim 1, further comprising:

cutting devices to cut the elongated intermediate product coming from said first casting line in case of emergency and to cut the elongated intermediate product coming from said at least one second casting line to produce a deliverable semi-finished product.

* * * * *